US006337433B1

(12) United States Patent
Nishimoto

(10) Patent No.: US 6,337,433 B1
(45) Date of Patent: Jan. 8, 2002

(54) ELECTRONIC MUSICAL INSTRUMENT HAVING PERFORMANCE GUIDANCE FUNCTION, PERFORMANCE GUIDANCE METHOD, AND STORAGE MEDIUM STORING A PROGRAM THEREFOR

(75) Inventor: Tetsuo Nishimoto, Hamamatsu (JP)

(73) Assignee: Yamaha Corporation (JP)

( * ) Notice: Subject to any disclaimer, the term of this patent is extended or adjusted under 35 U.S.C. 154(b) by 0 days.

(21) Appl. No.: 09/668,672

(22) Filed: Sep. 22, 2000

(30) Foreign Application Priority Data

Sep. 24, 1999 (JP) ..... 11-271401

(51) Int. Cl.[7] ..... A63J 17/00
(52) U.S. Cl. ..... 84/464 A; 84/478
(58) Field of Search ..... 84/464 A, 464 R, 84/470 R, 477 R, 478

(56) References Cited

U.S. PATENT DOCUMENTS

| | | | | |
|---|---|---|---|---|
| 5,107,743 A | * | 4/1992 | Decker | 84/478 |
| 5,286,909 A | * | 2/1994 | Shibukawa | 84/478 X |
| 5,392,682 A | * | 2/1995 | McCartney-Hoy | 84/470 R |
| 5,557,055 A | * | 9/1996 | Breitweiser, Jr. | 84/478 |
| 5,656,789 A | * | 8/1997 | Nakada et al. | 84/477 R |
| 5,907,115 A | | 5/1999 | Matsunaga et al. | 84/477 R |
| 6,087,577 A | * | 7/2000 | Yahata et al. | |

FOREIGN PATENT DOCUMENTS

| | | |
|---|---|---|
| JP | 6-301332 | 10/1994 |
| JP | 9-319363 | 12/1997 |
| JP | 10-91061 | 4/1998 |
| JP | 10-222053 | 8/1998 |
| JP | 11-7277 | 1/1999 |
| JP | 11-126072 | 5/1999 |

* cited by examiner

*Primary Examiner*—Jeffrey Donels
(74) *Attorney, Agent, or Firm*—Rossi & Associates

(57) ABSTRACT

There are provided an electronic musical instrument having a performance guidance function and a performance guidance method which enable a player to easily carry out a smooth and ideal performance even if the player is a beginner, and a storage medium storing a program for executing the same method. The electronic musical instrument has a plurality of display devices arranged in association with the performance operating elements, respectively, each comprising a pair of display elements corresponding to left and right hands of the player, respectively. Automatic performance data of a musical composition is input, for which the player is guided for performance. A position of each of the performance operating elements to be operated by the player and one of the left and right hands to be used in operating the each of the performance operating elements are indicated the player by driving a corresponding one of the pair of display elements of a corresponding display device in a manner corresponding to the one of the left and right hands, in response to the input performance data.

20 Claims, 9 Drawing Sheets

ELECTRONIC MUSICAL INSTRUMENT HAVING PERFORMANCE GUIDANCE FUNCTION, PERFORMANCE GUIDANCE METHOD, AND STORAGE MEDIUM STORING A PROGRAM THEREFOR

BACKGROUND OF THE INVENTION

1. Field of the Invention

The present invention relates to an electronic musical instrument having a performance guidance function of guiding a player to an ideal or perfect performance operation for playing a musical composition, based on input automatic performance data of the musical composition, a performance guidance method, and a storage medium storing a program for executing the same method.

2. Prior Art

Conventionally, as an electronic musical instrument of this kind, there has been proposed e.g. an electronic keyboard instrument having a performance guidance function. According to the proposed electronic keyboard instrument, when a player selects a desired musical composition and instructs the instrument to reproduce the same, keys to be operated for ideal performance are indicated to the player in the following manner: For instance, if the keys of the keyboard of the instrument are themselves capable of emitting light, keys located to be operated in accordance with reproduction of the selected musical composition are sequentially lighted in accordance with the reproduction. Alternatively, if the keyboard of the instrument is provided with light emitting diodes (LED's) arranged at a location adjacent to the keyboard in a manner associated with respective keys of the keyboard, LED's corresponding to keys located to be operated in accordance with reproduction of the selected musical composition are sequentially lighted in accordance with the reproduction.

Another conventional electronic keyboard instrument is provided with small liquid crystal displays (LCD's) arranged at a location adjacent to the keyboard in a manner associated with respective keys of the keyboard, and finger numbers each indicating a finger to be used for key depression are sequentially displayed on LCD's corresponding, respectively, to keys to be depressed, in accordance with reproduction of the selected musical composition.

However, according to the former conventional electronic keyboard instrument, nothing is done more than lighting keys to be operated or LED's corresponding to respective keys to be operated, so that when the keyboard is played with both hands, it is impossible for the player, especially for a beginner, to determine which finger of which hand should be used to operate a designated key. Further, even if the player is not a beginner, if a musical composition is played, which requires the player to position the left and right hands close to each other or cross them, the player often gets confused about which hand to use to operate a designated key, which results in an awkward performance which is far different from an ideal or perfect performance to be achieved by a smooth key operation.

According to the latter conventional electronic keyboard instrument, finger numbers indicative of respective fingers to be used are displayed by respective corresponding LCD's arranged at a location remote from the keyboard, and therefore the player is required to look away from the keyboard to see the finger numbers, which makes it difficult to play the keyboard especially when the player is a beginner.

SUMMARY OF THE INVENTION

It is an object of the invention to provide an electronic musical instrument having a performance guidance function and a performance guidance method which enable a player to easily carry out a smooth and ideal performance even if the player is a beginner, and a storage medium storing a program for executing the same method.

To attain the above object, according to a first aspect of the present invention, there is provided an electronic musical instrument having a plurality of performance operating elements that are operated for performance by a player such that different parts of a body of the player are selectively used to operate predetermined ones of the performance operating elements, the electronic musical instrument comprising an input device that inputs performance data of a musical composition for which the player is guided for performance, and a plurality of display devices that are arranged in association with the performance operating elements, respectively, the display devices each comprising a pair of display elements corresponding to left and right hands of the player, respectively, the display devices being each responsive to the input performance data for indicating to the player a position of a corresponding one of the performance operating elements to be operated by the player and one of the left and right hands to be used in operating the corresponding one of the performance operating elements, by driving a corresponding one of the pair of display elements in a manner corresponding to the one of the left and right hands.

Here, the term "electronic musical instrument" refers, e.g. to an electronic keyboard instrument or an electronic stringed instrument (electric guitar, electric bass, etc), and the term "a plurality of performance operating elements" refers, e.g. to keys of the keyboard if the electronic musical instrument is an electric keyboard instrument, and strings if the electronic musical instrument is an electric stringed instrument. Further, the term "different parts of a body of the player" refers, e.g. to fingers of left and right hands if the electronic musical instrument is an electronic keyboard instrument, or, if the electronic musical instrument is an electronic stringed instrument.

The position of each of performance operating elements to be operated by the player is determined based on pitch information contained in the input automatic performance data. Since the automatic performance data necessarily include pitch information, there is no problem in determining the position based on pitch information. On the other hand, information concerning the parts of the body (left and right hands of the player) to be used in operating the performance operating elements is not included in ordinary automatic performance data. Therefore, if the input automatic performance data do not include the information concerning the parts of the body to be used for the operation, this information is required to be produced from the input automatic performance data. The expression "based on the automatic performance data" implies that the information on the different parts of the body is generated from the input automatic performance data if required.

Preferably, the pair of display elements indicate respective corresponding ones of the left and right hands of the player in different colors from each other.

Also preferably, one of the pair of display elements corresponding to one of the left and right hands of the player indicates a finger of the one of the left and right hands of the player to be used in operating the corresponding one of the performance operating elements, in a display manner corresponding to the finger.

More specifically, it is preferable that one of the pair of display elements corresponding to one of the left and right hands of the player is driven to emit light with a level of brightness corresponding to a finger of the one of the left and right hands of the player to be used in operating the corresponding one of the performance operating elements, to thereby indicate the finger.

To attain the above object, according to a second aspect of the present invention, there is provided an electronic musical instrument having a plurality of performance operating elements that are operated for performance by a player such that different parts of a body of the player are selectively used to operate predetermined ones of the performance operating elements, the electronic musical instrument comprising an input device that inputs performance data of a musical composition for which the player is guided for performance, a plurality of first display devices that are arranged in association with the performance operating elements, respectively, the first display devices being each responsive to the input performance data for indicating to the player a position of a corresponding one of the performance operating elements to be operated by the player and one of the different parts of the body to be used in operating the corresponding one of the performance operating elements, in a manner corresponding to the one of the different parts of the body, and a second display device provided independently of the plurality of performance operating elements for displaying a picture representative of the plurality of performance operating elements, the second display device being responsive to the input performance data for displaying a position of each of the performance elements to be operated by the player on the picture displayed on the second display device, and simultaneously displaying a pattern corresponding to one of the different parts of the body to be used in operating the each of the performance operating elements in a manner associated with an image of the each of the performance operating elements to be operated by the player in the picture.

Further, the expression "a manner corresponding to the one of the different parts of the body" is intended to mean any manner insofar as any one of the different parts of the body can be instantly identified when indicated in the manner. This manner is more specifically defined in the following preferred embodiments of the first aspect of the invention.

The above described points also apply to the following preferred embodiments.

Preferably, the first display devices are each responsive to the input performance data for indicating to the player the position of the corresponding one of the performance operating elements to be operated by the player and the one of the different parts of the body to be used in operating the corresponding one of the performance operating elements, in a color corresponding to the one of the different parts of the body.

Preferably, the first display devices associated with respective ones of the performance operating elements to be operated by the player are each operated to emit light in a light emission manner corresponding to one of the different parts of the body to be used in operating the performance operating element.

Here, the term "light emission manner" refers, e.g., to a state of setting of one or more of light color, light brightness, duty ratio of lighting (lighting/extinction ratio), position of light emission, etc. This also applies to the other preferred embodiments.

More preferably, each of the first display devices has a pair of display elements arranged in a manner corresponding to left and right hands of the player, respectively, and when one of the performance operating elements corresponding to one of the first display devices is to be operated by the player with one of the left and right hands of the player, one of the pair of display elements of the one of the first display devices that corresponds to the one of the left and right hands of the player, is operated to emit light.

Still more preferably, the one of the pair of display elements of the one of the first display devices that corresponds to the one of the left and right hands of the player, is operated to emit light in a color corresponding to the one of the left and right hands.

Also preferably, the electronic musical instrument includes a keyboard having keys, and the performance operating elements are the keys of the keyboard, and the light emission manner is determined by brightness of the light which is set to different levels corresponding to respective fingers of each of the left and right hands.

Here, the term "pattern" used in the second aspect means a picture of a corresponding one of the fingers, e.g. when the parts of the body are fingers.

More preferably, the position of each of the performance operating elements to be operated by the player is indicated by an image of the one of the different parts of the player, which is displayed in a manner superimposed on the picture.

Further preferably, the electronic musical instrument includes a keyboard having keys, the performance operating elements are the keys of the keyboard, the picture being a picture of the keyboard, the parts of the body of the player being fingers of both hands of the player, ones of the fingers of the both hands to be used for performance being each displayed in a highlighted manner in the vicinity of the each of the performance operating elements to be operated by the player.

Preferably, the indication device comprises a voice generating device that generates voice, and a pitch name corresponding to the position of each of the performance operating elements to be operated by the player is sounded by the voice generating device in a tone color corresponding to the one of the different parts of the body.

To attain the above object, according to a third aspect of the present invention, there is provided an electronic musical instrument having a plurality of performance operating elements that are operated for performance by a player such that different parts of a body of the player are selectively used to operate predetermined ones of the performance operating elements, the electronic musical instrument comprising an input device that inputs performance data of a musical composition for which the player is guided for performance, and an indicating device that is responsive to the input performance data for sounding a pitch name corresponding to a position of each of the performance operating elements to be operated by the player in a voice having a tone color corresponding to one of the different parts of the body to be used in operating the each of the performance elements.

Here, as an example of the tone color, assuming that the parts of the body are fingers of both hands, the tone color refers to an alien's voice for the left hand, a human's voice for the right hand, an adult human's voice for a thumb, an infant's voice for a little finger.

Preferably, in the third aspect, the indicating device sounds the pitch name in a voice having a tone color different depending on whether the one of the different parts of the body to be used in operating the each of the performance elements is a left hand of the player or a right hand of same.

Also preferably, the indicating device sounds the pitch name in a voice having a tone color different depending on a finger of the player to be used in operating the each of the performance elements.

The electronic musical instrument according to the third aspect further comprises a plurality of display devices that are arranged in association with the performance operating elements, respectively, and the display devices are each responsive to the input performance data for indicating to the player a position of a corresponding one of the performance operating elements to be operated by the player and one of the different parts of the body to be used in operating the corresponding one of the performance operating elements.

Further, in the electronic musical instrument according to the third aspect, preferably, the display devices each display the position of the corresponding one of the performance operating elements to be operated by the player and the one of the different parts of the body to be used in operating the corresponding one of the performance operating elements in a manner corresponding to the one of the different parts of the body.

Also preferably, the electronic musical instrument according to the third aspect further comprises a display device provided independently of the plurality of performance operating elements for displaying a picture representative of the plurality of performance operating elements, and the display device are responsive to the input performance data for displaying the position of the each of the performance elements to be operated by the player on the picture displayed on the display device.

Preferably, this display device displays a pattern corresponding to the one of the different parts of the body to be used in operating the each of the performance operating elements in a manner associated with an image of the each of the performance operating elements to be operated by the player in the picture.

To attain the above object, according to a fourth aspect of the present invention, there is provided a method of guiding a player for performance, the player playing on an electronic musical instrument having a plurality of performance operating elements that are operated for performance by the player such that different parts of a body of the player are used to suitably operate predetermined ones of the performance operating elements, the method comprising the steps of arranging a plurality of display devices in association with the performance operating elements, respectively, the display devices each comprising a pair of display elements corresponding to left and right hands of the player, respectively, inputting automatic performance data of a musical composition for which the player is guided for performance, and indicating to the player a position of each of the performance operating elements to be operated by the player and one of the left and right hands to be used in operating the each of the performance operating elements, by driving a corresponding one of the pair of display elements of a corresponding one of the display devices in a manner corresponding to the one of the left and right hands, in response to the input performance data.

To attain the above object, according to a fifth aspect of the present invention, there is provided a method of guiding a player for performance, the player playing on an electronic musical instrument having a plurality of performance operating elements that are operated for performance by the player such that different parts of a body of the player are used to suitably operate predetermined ones of the performance operating elements, the method comprising the steps of arranging a plurality of first display devices in association with the performance operating elements, respectively, arranging a second display device independently of the plurality of performance operating elements, inputting performance data of a musical composition for which the player is guided for performance, and indicating to the player a position of a corresponding one of the performance operating elements to be operated by the player and one of the different parts of the body to be used in operating the corresponding one of the performance operating elements, by driving a corresponding one of the plurality of first display devices in a manner corresponding to the one of the different parts of the body, in response to the input performance data, and displaying a position of each of the performance elements to be operated by the player on the picture displayed on the second display device, and simultaneously displaying a pattern corresponding to one of the different parts of the body to be used in operating the each of the performance operating elements in a manner associated with an image of the each of the performance operating elements to be operated by the player in the picture, by driving the second display device in response to the input performance data.

To attain the above object, according to a sixth aspect of the present invention, there is provided a method of guiding a player for performance, the player playing on an electronic musical instrument having a plurality of performance operating elements that are operated for performance by the player such that different parts of a body of the player are used to suitably operate predetermined ones of the performance operating elements, the method comprising the steps of inputting performance data of a musical composition for which the player is guided for performance, and sounding a pitch name corresponding to a position of each of the performance operating elements to be operated by the player in a voice having a tone color corresponding to one of the different parts of the body to be used in operating the each of said performance elements, in response to the input performance data.

To attain the above object, according to a seventh aspect of the invention, there is provided a storage medium storing a program that can be executed by a computer, the program be capable of realizing a method of guiding a player for performance, the player playing on an electronic musical instrument having a plurality of performance operating elements that are operated for performance by the player such that different parts of a body of the player are used to suitably operate predetermined ones of the performance operating elements, and a plurality of display devices arranged in association with the performance operating elements, respectively, the display devices each comprising a pair of display elements corresponding to left and right hands of the player, respectively, the program comprising an input module for inputting automatic performance data of a musical composition for which the player is guided for performance, and an indication module for indicating to the player a position of each of the performance operating elements to be operated by the player and one of the left and right hands to be used in operating the each of the performance operating elements, by driving a corresponding one of the pair of display elements of a corresponding one of the display devices in a manner corresponding to the one of the left and right hands, in response to the input performance data.

To attain the above object, according to an eighth aspect of the invention, there is provided a storage medium storing a program that can be executed by a computer, the program be capable of realizing a method of guiding a player for performance, the player playing on an electronic musical instrument having a plurality of performance operating elements that are operated for performance by the player such that different parts of a body of the player are used to suitably operate predetermined ones of the performance operating elements, a plurality of first display devices that are arranged in association with the performance operating elements, respectively, and a second display device provided independently of the plurality of performance operating elements for displaying a picture representative of the plurality of performance operating elements, the program comprising an input module for inputting performance data of a musical composition for which the player is guided for performance, an indicating module for indicating to the player a position of a corresponding one of the performance operating elements to be operated by the player and one of the different parts of the body to be used in operating the corresponding one of the performance operating elements, by driving a corresponding one of the plurality of first display devices in a manner corresponding to the one of the different parts of the body, in response to the input performance data, and a displaying module for displaying a position of each of the performance elements to be operated by the player on the picture displayed on the second display device, and simultaneously displaying a pattern corresponding to one of the different parts of the body to be used in operating the each of the performance operating elements in a manner associated with an image of the each of the performance operating elements to be operated by the player in the picture, by driving the second display device in response to the input performance data.

To attain the above object, according to a ninth aspect of the invention, there is provided a storage medium storing a program that can be executed by a computer, the program be capable of realizing a method of guiding a player for performance, the player playing on an electronic musical instrument having a plurality of performance operating elements that are operated for performance by the player such that different parts of a body of the player are used to suitably operate predetermined ones of the performance operating elements, the program comprising an input module for inputting performance data of a musical composition for which the player is guided for performance, and an indicating module for sounding a pitch name corresponding to a position of each of the performance operating elements to be operated by the player in a voice having a tone color corresponding to one of the different parts of the body to be used in operating the each of the performance elements, in response to the input performance data.

The above and other objects, features and advantages of the invention will become more apparent from the following detailed description taken in conjunction of the accompanying drawings.

DETAILED DESCRIPTION

The present invention will now be described in detail with reference to the drawings showing an embodiment thereof.

Figure 1:
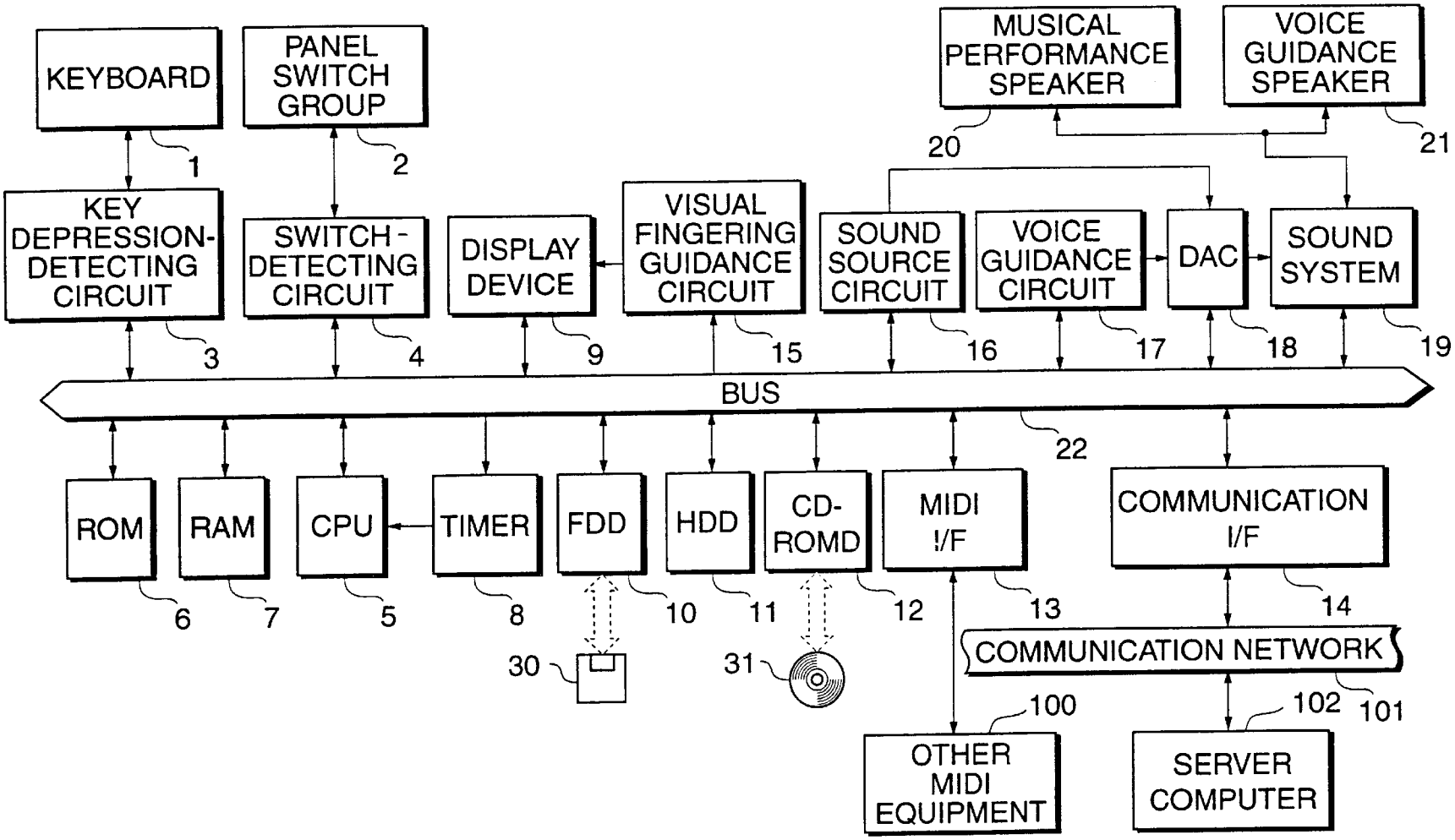
FIG. 1 is a block diagram schematically showing the arrangement of an electronic musical instrument having a performance guidance function, according to an embodiment of the present invention.

FIG. 1 schematically shows the arrangement of an electronic musical instrument having a performance guidance function, according to an embodiment of the invention.

As shown in the figure, the electronic musical instrument includes a keyboard 1 for entering pitch information, a panel switch group 2 comprised of a plurality of switches for inputting various kinds of information, a key depression-detecting circuit 3 for detecting a depressed state of each key on the keyboard 1, a switch-detecting circuit 4 for detecting ON/OFF states of each switch of the panel switch group 2, a CPU 5 for controlling the whole system, a ROM 6 storing control programs to be executed by the CPU 5, various kinds of table data, and so forth, and a RAM 7 for temporarily storing performance data, various kinds of input information, operation results and others. The electronic musical instrument also includes a timer 8 for counting an interrupt time for a timer interrupt routine and various other times, a display device 9 comprised of a liquid crystal display (LCD) for displaying various kinds of information and a plurality of guide lamps (described in detail hereinafter with reference to FIGS. 3A, 3B) arranged in a manner associated with the respective keys of the keyboard 1, for each indicating the position of a corresponding key to be depressed and a finger to be used for the key depression, a floppy disk drive (FDD) 10 for driving a floppy disk (FD) 30 as a storage medium, a hard disk drive (HDD) 11 for driving a hard disk (not shown) which stores various application programs including the above mentioned control programs and various kinds of data, and a CD-ROM drive (CD-ROMD) 12 for driving a compact disk-read only memory (CD-ROM) 31 which stores various application programs including the control programs and various kinds of data similarly to the hard disk. The electronic musical instrument further includes a MIDI interface (I/F) 13 which transmits and receives MIDI (Musical Instrument Digital Interface) signals to and from external devices, a communication interface (I/F) 14 which transmits and receives data to and from a server computer 102, for example, through a communication network 101, a visual finger-motion guidance circuit 15 which controls ON/OFF of the guide lamps to carry out visual guide of the player's fingering, a tone generator 16 which converts performance data entered via the keyboard 1 or preset performance data to musical tone signals, a voice guidance circuit 17 which outputs voice signals for voice guidance, a DAC (Digital-to-Analog Converter) 18 which converts digital musical tone signals and voice signals supplied, respectively, from the tone generator 16 and the voice guidance circuit 17 to analog musical tone signals and voice signals, respectively, a sound system 19 including an amplifier for amplifying analog musical tone signals and voice signals output from the DAC 18, a musical performance speaker 20 which converts analog musical tone signals output from the sound system 19 to musical sound, and a voice guidance speaker 21 which converts analog voice signals output from the sound system 19 to voice.

The above component elements 3 to 19 are connected to each other via a bus 22. Further, direct connections are established, respectively, between the CPU 5 and the timer 8, between the display device 9 and the visual finger-motion guidance circuit 15, between the MIDI I/F 13 and other MIDI equipment 100, between the communication I/F 14 and the communication network 101, between the DAC 18, and the tone generator 16, the voice guidance circuit 17, and the sound system 19, and between the sound system 19, and the speakers 20 and 21.

The hard disk set in the HDD 11 is capable of storing the control programs to be executed by the CPU 5, as described above. When the ROM 6 does not store the control programs, they may be stored in the hard disk and read therefrom into the RAM 7, whereby the CPU 5 can perform the same operations as in the case where the control programs are stored in the ROM 6. This arrangement facilitates addition of control programs and updating of the version of the programs.

Control programs and various kinds of data read from the CD-ROM 31 set in the CD-ROM drive 12 are stored in the hard disk in the HDD 11, whereby addition of control programs and updating of the version of the programs are facilitated. It should be noted that an external storage device, such as a magneto-optical disk (MO), which allow utilization of various forms of media, may be provided in addition to the CD-ROM drive 12.

The MIDI I/F 13 is not required to be one exclusively provided for MIDI data, but it may be formed by a general-purpose interface, such as an RS-232C, a USB (Universal Serial Bus), an IEEE 1394, or the like. In this case, data other than MIDI messages can be also transmitted or received.

As described above, the communication I/F 14 is connected to the communication network 101, such as a LAN (Local Area Network), the Internet, and a telephone line, and is connected to the server computer 102 through the communication network 101. When some programs or parameters are not stored in the hard disk 11, the communication I/F 14 is used for downloading the missing programs or parameters from the server computer 102. A client computer (electronic musical instrument in the present embodiment) transmits commands to the server computer 102 through the communication network 101, thereby requesting downloading of the desired programs and parameters. The server computer 102 receives the commands and delivers the requested programs and parameters to the client computer through the communication network 101, and the computer receives these programs and parameters through the communication I/F 14, and stores them in the hard disk in the HDD 11, whereby the downloading is completed.

Further to the above, the electronic musical instrument of the present embodiment may be provided with an interface for directly transmitting and receiving data to and from an external computer or the like.

Figure 2:
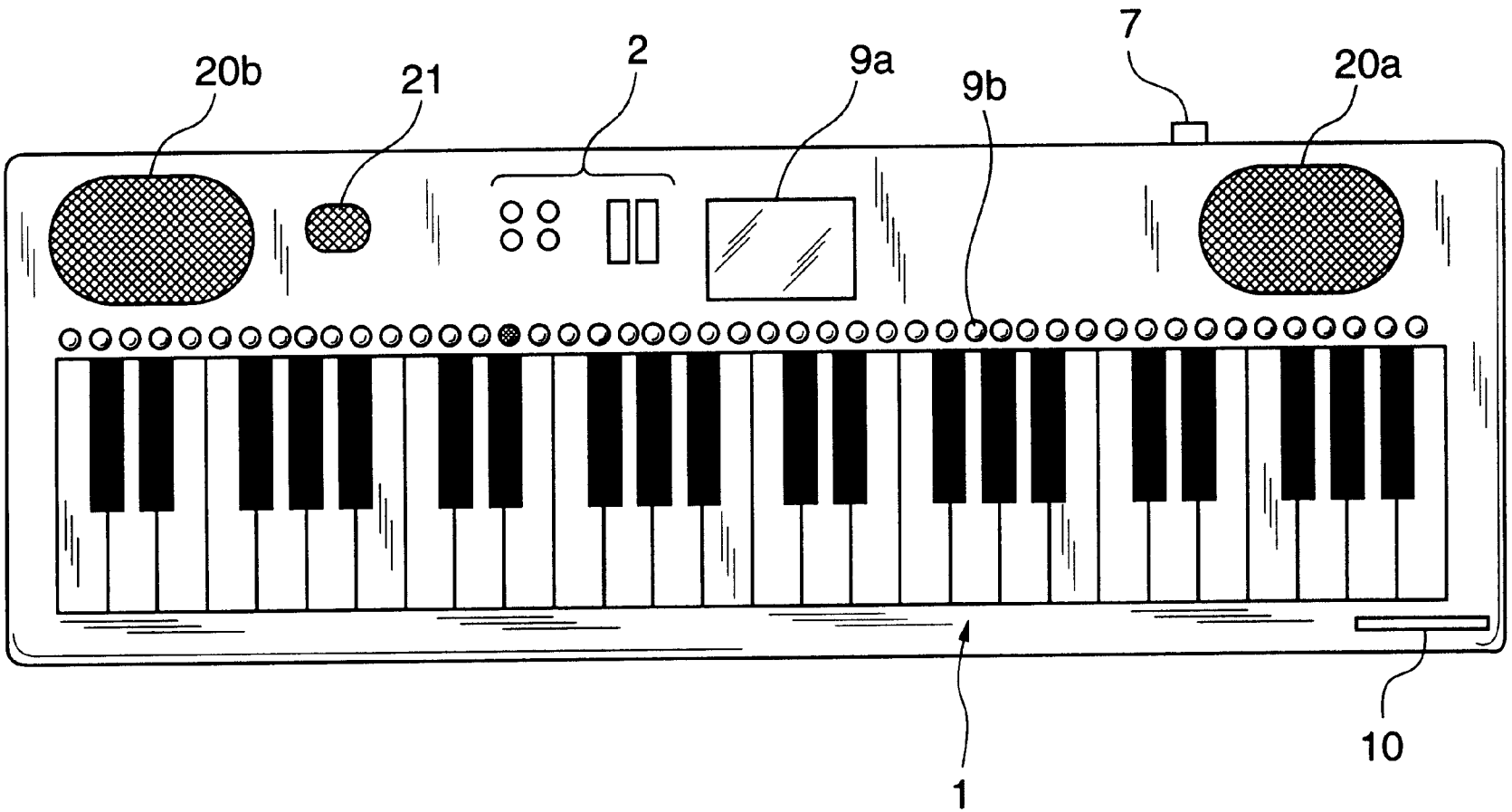
FIG. 2 is a plan view of the FIG. 1 electronic musical instrument.

As shown in FIG. 2, an LCD 9*a* of the display device 9 is arranged generally in the center of the electronic musical instrument of the embodiment. When a panel setting mode for changing the kind, value, and the like of a parameter assigned to each of the switches of the panel switch group 2 is selected, the LCD 9*a* is used for displaying the kinds and values of the assigned parameters. On the other hand, when an automatic performance mode for execution of automatic performance is selected, the title, value of a tempo, etc. of a musical composition under automatic performance are displayed on the LCD 9*a*.

As shown in FIG. 2, the guide lamps 9*b* of the display device 9 are arranged in a row at a location adjacent to the keyboard 1 in a manner associated with the respective keys of the keyboard 1.

Figure 3A:
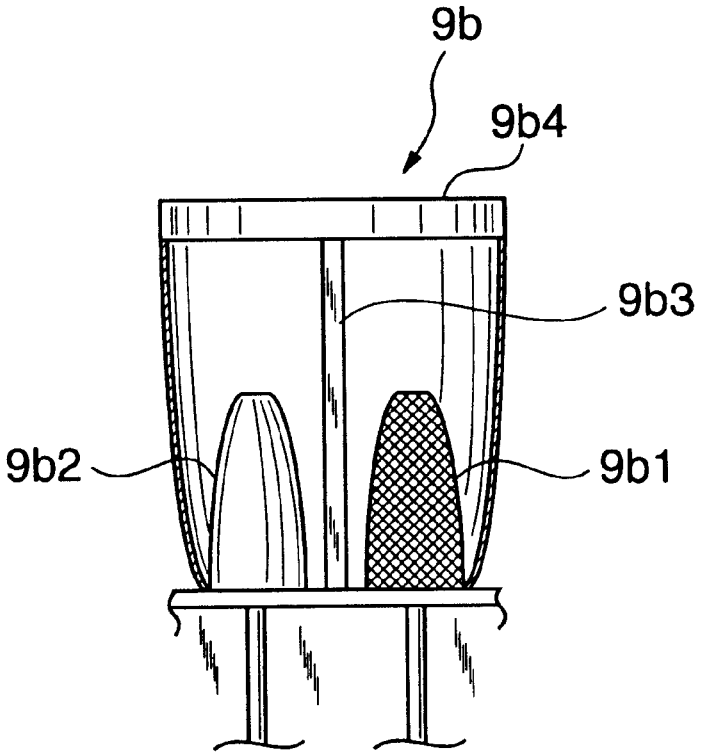
FIGS. 3A and 3B are views which are useful in explaining the construction of guide lamps appearing in FIG. 2.
Figure 3B:
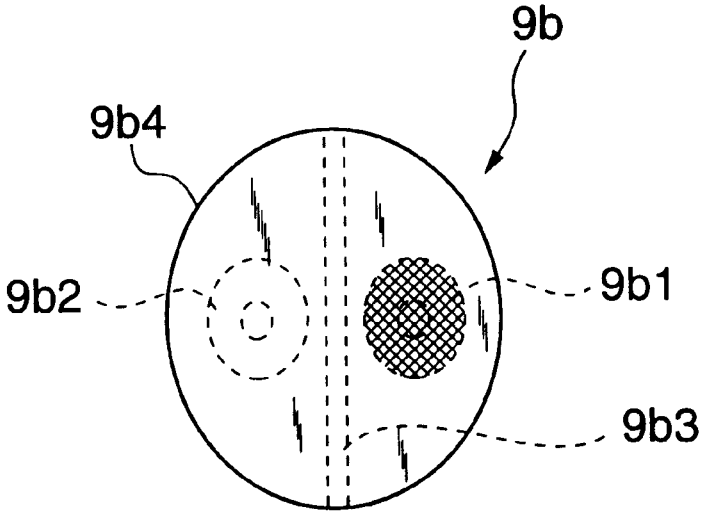

FIGS. 3A and 3B show one guide lamp 9*b* as a representative of those appearing in FIG. 2, for explaining the construction of the guide lamp 9*b*. FIG. 3A shows the guide lamp 9*b* in sectional side view on an enlarged scale, while FIG. 3B shows the same in plan view on an enlarged scale.

As shown in FIG. 3A, the guide lamp 9*b* is comprised of a pair of LED's 9*b* 1, 9*b* 2 which emit light in respective different colors, a partition wall 9*b*3 for preventing interference between the two lights emitted from the LED's 9*b*1, 9*b*2, and a lens 9*b*4 for amplifying each of the two lights. In the present embodiment, the LED 9*b*1 is lighted in green, while the LED 9*b*2 is lighted in red.

As described in detail hereinafter, as long as a lamp guidance function is enabled, the ON/OFF of the guide lamps 9*b* is controlled in three patterns, i.e. a pattern of only the LED 9*b*1 being lighted, a pattern of only the LED 9*b*2 being lighted, and a pattern of the LED's 9*b*1 and 9*b*2 are both extinguished. The reason why a pattern of the LED's 9*b*1 and 9*b*2 being both lighted simultaneously is not employed is that the pattern of the right-hand LED (i.e. the LED 9*b*1) being lighted instructs the player to depress the corresponding key with a finger of his right hand, while the pattern of the left-hand LED (i.e. the LED 9*b*2) being lighted instructs the player to depress the corresponding key with a finger of his left hand, and that this manner of instruction is most natural. Further, when "lamp-aided hand-motion/fingering guidance", described in detail hereinafter, is selected as a lamp guidance function, any one of the LED's 9*b*1 and 9*b*2 that is being lighted is changed in brightness according to a finger to be used for key depression, thereby enabling the player to immediately recognize the finger. The control of the lighting/extinction/brightness of the LED's 9*b*1 and 9*b*2 is executed by the visual finger-motion guidance circuit 15.

It should be noted that in FIGS. 3A, 3B, there is shown the state of the LED 9*b*1 alone being lighted, i.e. the state of the player being instructed to depress the corresponding key with a finger of his right hand.

In the present embodiment, the visual guidance for fingering is effected not only by controlling lighting/extinction/brightness of the guide lamps 9*b* associated with the respective keys of the keyboard 1, as described above, but also by displaying a picture of the whole keyboard 1 on the LCD 9*a*, as well as displaying an image of both hands brought to the vicinity of keys to be depressed, with fingers for depressing the keys in a highlighted manner.

It should be noted that LED's capable of changing the color of emission light may be employed to guide the fingering so as to reproduce delicate light color changes, instead of changing the brightness. In a further variation of the present embodiment, the duty ratio between the ON time and OFF time of the guide lamp 9*b* is changed to thereby change the blinking pattern of the guide lamp 9*b* according to the fingering.

Referring again to FIG. 2, the musical performance speaker 20 is comprised of two speakers 20*a*, 20*b* arranged on respective right-hand and left-hand sides of the electronic musical instrument. The right-hand speaker 20*a* converts right-channel signals of stereo musical tone signals to musical sound, while the left-hand speaker 20*b* converts left-channel signals of the same to musical sound.

On the other hand, the voice guidance speaker 21 is arranged in the vicinity of the left-hand speaker 20*b*, as shown in FIG. 2, for indicating the position of each key to be depressed, in voice, based on automatic performance data.

In the present embodiment, as described in detail hereinafter, the electronic musical instrument is provided with two kinds of voice guidance functions, i.e. "voice-aided tone-pitch guidance" and "voice-aided pitch/fingering guidance". The electronic musical instrument guides the player to the position of a key to be depressed, by indicating a pitch name in voice, and specifies a finger to be used to depress the key, e.g. by using a specific tone of voice corresponding to the finger. More specifically, when a thumb is to be used to depress keys, each pitch name, such as "do", "re", "mi", etc. is sounded in an adult male's voice, and when a little finger is to be used, each pitch name is sounded in an infant's voice. Further, to enable the player to discriminate between the left and right hands, the electronic musical instrument utilizes two kinds of voices different in tone color, such as a cheerful voice and a gloomy voice, a human voice and an alien's voice, or the like. Voice signals used for these purposes are generated by the aforementioned voice guidance circuit 17.

Also in the present embodiment, as described in detail hereinafter, it is possible to disable the voice guidance function. When the voice guidance function is disabled, voice sound is not generated by the voice guidance speaker 21. In this case, if the lamp guidance function is enabled, the performance guidance by the guide lamps 9*b* alone is carried out according to the kind of the lamp guidance function that is then set. In the present embodiment, however, the lamp guidance function can also be disabled as described hereinafter, so that when the voice guidance function and the lamp guidance function are both disabled, no performance guidance is provided at all.

As shown in FIG. 2, the switches of the panel switch group 2 are collectively arranged at a location adjacent to the LCD 9*a*. The panel switch group 2 includes a switch for selecting a plurality of performance modes, a switch for setting tone colors of musical sound output from the musical performance speaker 20 and voice sound output from the voice guidance speaker 21, and a switch for selectively setting a desired one of the voice guidance functions and a desired one of the lamp guidance functions, and so forth.

It should be noted that although the electronic musical instrument of the present embodiment is constructed on a general-purpose computer as is apparent from the above description, this is not limitative, but it may be constructed on a dedicated apparatus comprised of fewest possible component elements for implementing the present invention.

In the following, first, the summary of the control processes performed by the electronic musical instrument constructed as above will be described, and then details of the control processes will be explained with reference to FIGS. 4 to 7.

The electronic musical instrument of the embodiment mainly carries out (1) voice guidance, (2) lamp guidance, and (3) hand guidance.

(1) The voice guidance is a performance guidance process which the electronic musical instrument performs by delivering a voice message via the voice guidance speaker 21 as described above. In the present embodiment, it is possible for the player to select as required between the two kinds of voice guidance functions, i.e. "voice-aided tone-pitch guidance" for indicating a pitch name alone in voice to thereby guide the player to a key to be depressed and "voice-aided pitch/fingering guidance" for indicating not only a pitch name but also the name of a finger in voice, to thereby guide the player to a key to be depressed and indicate a finger to be used for the key depression. Further, it is possible to selectively disable the voice guidance functions.

(2) The lamp guidance is a performance guidance process which the electronic musical instrument performs by controlling the lighting/extinction/brightness of each guide lamp 9*b* as described above. In the present embodiment, it is possible for the player to select as required between the two kinds of lamp guidance functions, i.e. "lamp-aided key guidance" for guiding the player to only the position of a key to be depressed, by lighting the corresponding guide lamp 9*b* and "lamp-aided hand-motion/fingering guidance" for guiding the player to a key to be depressed and indicating a finger to be used for the key depression, by changing the brightness of the guide lamp 9*b*. Further, it is possible to selectively disable the lamp guidance functions.

(3) The hand guidance is a performance guidance process which the electronic musical instrument performs by displaying a picture of the whole keyboard 1 and a picture of both hands, with the latter superimposed upon the former and one or more fingers in use for key depression displayed in a manner distinguishable from the other fingers which are not in use for key depression. For instance, fingers in use are each displayed as a filled image, and the other fingers as a hollow one, or alternatively, fingers in use and the other fingers are displayed in two different colors.

Next, these control processes are described in detail.

Figure 4:
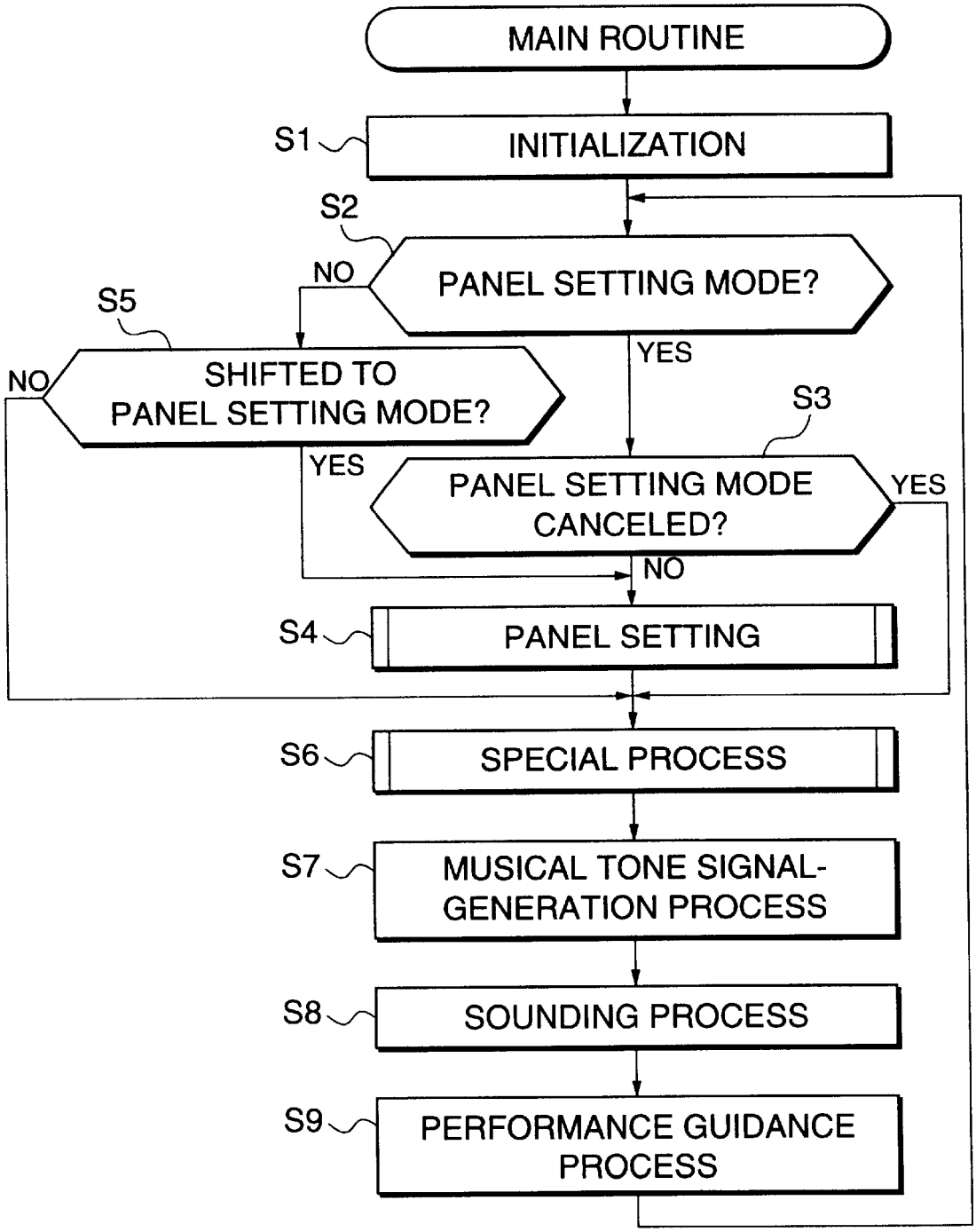
FIG. 4 is a flowchart showing a main routine executed by the FIG. 1 electronic musical instrument, particularly by a CPU thereof.

FIG. 4 shows a main routine which is executed by the electronic musical instrument of the present embodiment, particularly by the CPU 5.

As shown in the figure, first, at a step S1, the initialization of the system, including clearing of the RAM 7 and tempo setting, is carried out.

Figure 5A:
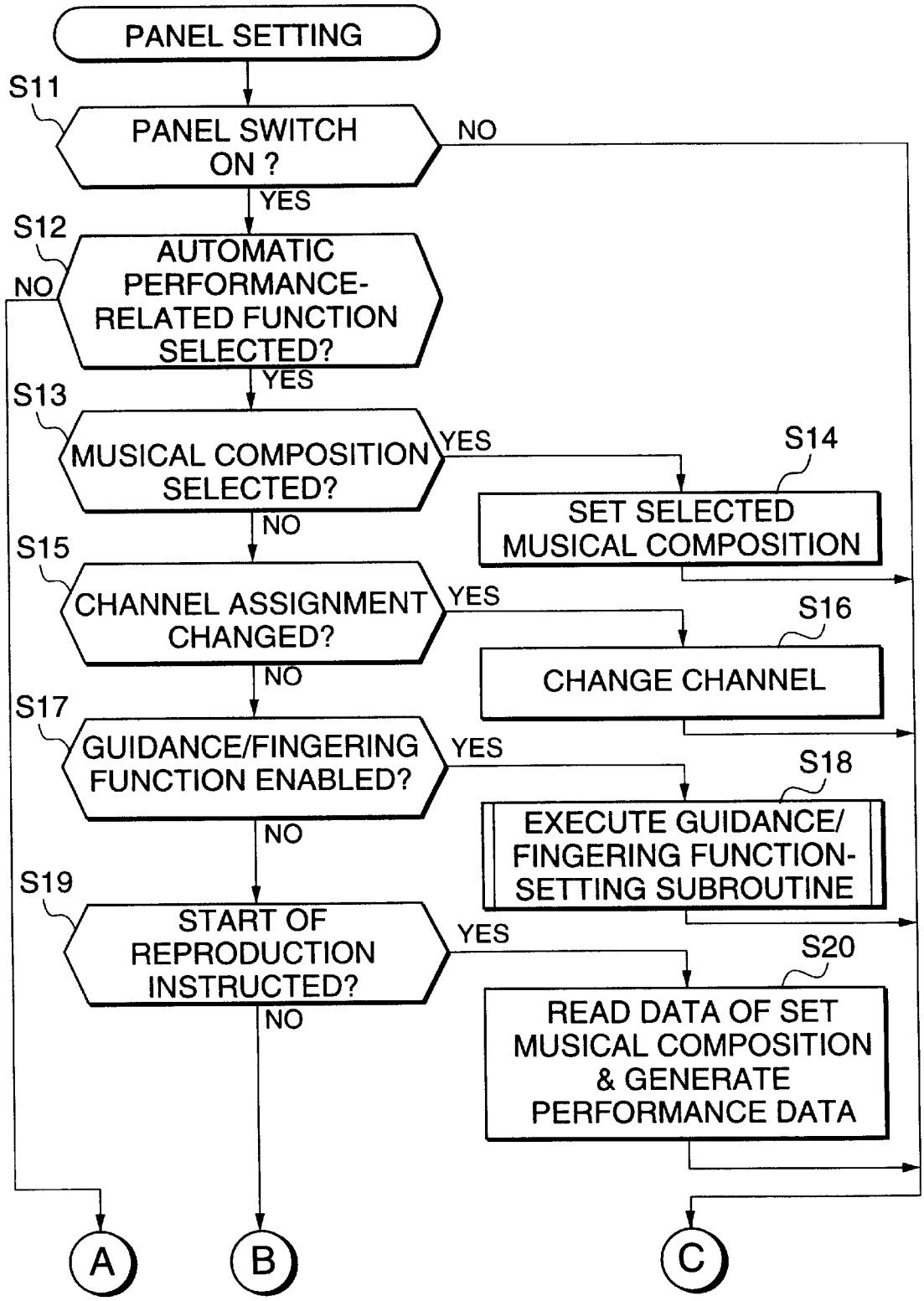
FIGS. 5A and 5B are a flowchart showing in detail a panel setting subroutine in FIG. 4.
Figure 5B:
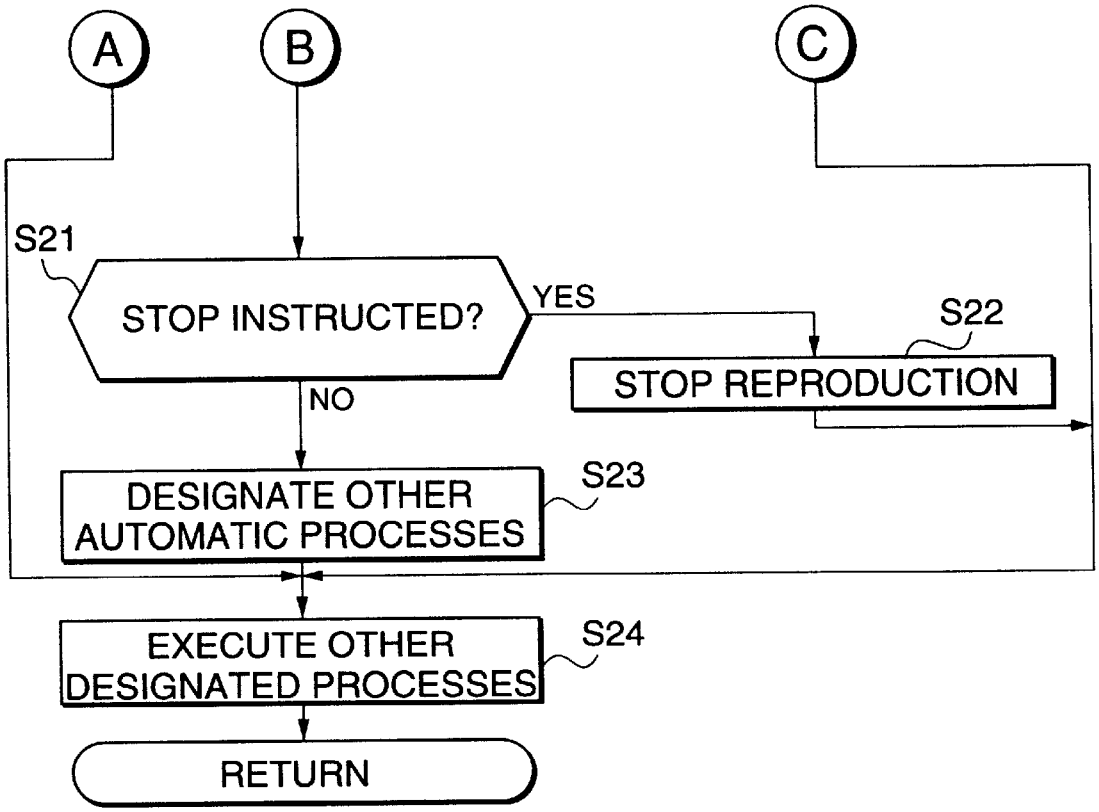
Figure 6:
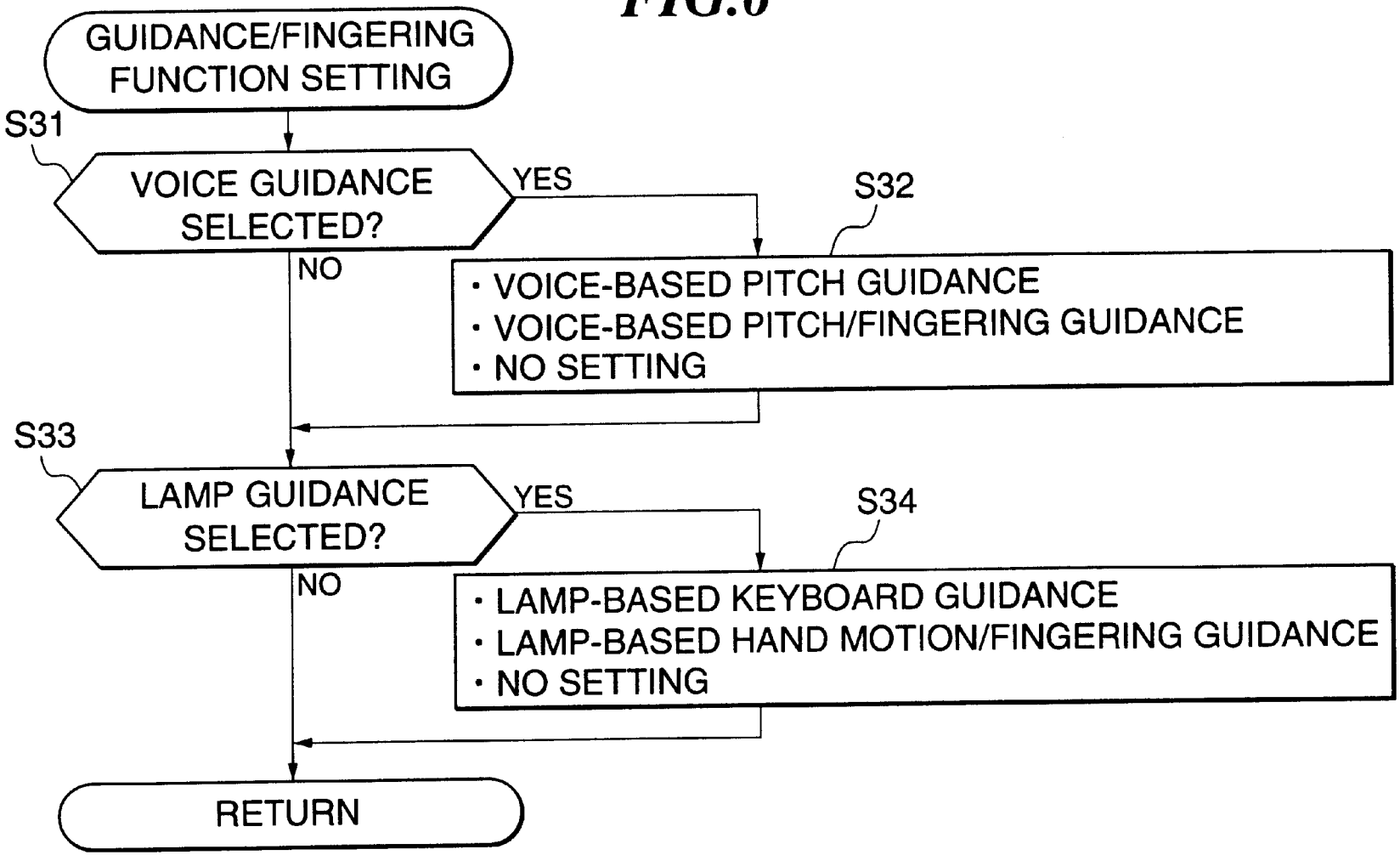
FIG. 6 is a flowchart showing details of a guidance/fingering function-setting process in FIG. 5 executed by a subroutine therefor.

Then, if a mode set at present is the panel setting mode, and if the panel setting mode is not canceled by the player, or if a mode set at present is not the panel setting mode, and if the player switches the present mode to the panel setting mode, a panel setting subroutine, which will be described in detail hereinafter with reference to FIGS. 5 and 6, is executed (steps S2→S3→S4 or steps S2→S5→S4). On the other hand, if the above conditions are not satisfied, the step S4 is skipped, and the program proceeds to a step S6.

At the step S6, a special process subroutine, described in detail hereinafter with reference to FIG. 7, is executed. Then, a musical tone signal-generating process and a sounding process for converting the generated musical tone signals to musical sound are executed at steps S7 and S8, respectively. Further, at a step S9, a performance guidance process is executed in response to generated guide signals. Thereafter, the program returns to the step S2, and then the steps S2 to S9 are repeatedly carried out.

In the special process subroutine executed at the step S6, processes are mainly carried out for (1) reading automatic performance data of channels other than a guide channel (assigned to the keyboard 1) to perform automatic performance, (2) reading automatic performance data of the guide channel, for visual guidance or voice guidance of the player to pitch names when the guidance function (at least one of the voice guidance function and the lamp guidance function) is enabled, and (3) generating fingering control data (or reading the fingering control data when the same data is included in the automatic performance data) for visual guidance or voice guidance of the fingering of the player when the fingering guidance function (at least one of the voice-aided pitch/fingering guidance and the lamp-aided hand-motion/fingering guidance) is enabled.

In the musical tone signal-generating process executed at the step S7, processes are performed for generating musical tone signals based on the automatic performance data read out through the above processes (1) and (2), and for generating musical tone signals based on the automatic performance data entered via the keyboard 1 by the player.

In the sounding process executed at the step S8, musical tone signals generated at the step S7 are allocated to the tone generator 16 for sounding of the same.

In the performance guidance process executed at the step S9, performance guidance is performed in voice or by the guide lamps 9*b,* based on the automatic performance data of the guide channel read out by the above process (2) and the fingering control data generated by the above process (3). Further, when at least one of the performance guidance in voice (i.e. voice-aided guidance) and the performance guidance by the guide lamps 9*b* (i.e. lamp-aided guidance) is enabled, a picture of the whole keyboard 1 and a picture of both hands are displayed on the LCD 9*a,* with the latter superimposed upon the former, and one or more fingers in use for key depression are displayed in a manner distinguishable from the other fingers which are not in use for key depression. For instance, fingers in use are each displayed as a filled image, and the other fingers as a hollow one, or alternatively, fingers in use and the other fingers are displayed in two different colors.

FIGS. 5A and 5B show in detail the panel setting subroutine executed at the step S4.

As shown in the figure, first, it is determined at a step S11 whether or not any one of the switches of the panel switch group 2 has been depressed. If any one of the switches has been depressed, the program proceeds to a step S12. On the other hand, if none of the switches have been depressed, the program proceeds to a step S24, wherein other designated settings are executed, followed by terminating the program.

At the step S12, it is determined whether or not at least one of the functions related to automatic performance has been selected. If any one of the functions has been selected, processes described below are executed, whereas if none of the functions have been selected, the program proceeds to the step S24.

When any one of the functions related to automatic performance has been selected, a corresponding one of the following processes is executed according to the kind of the selected function:

(1) if the player selected a musical composition, the selected musical composition is set (S13→S14→S24).

At a time point the power of the electronic musical instrument of the embodiment is turned on, a musical composition selected last time remains set. Data of the selected musical composition is supplied by being read from the storage medium, such as the FD 30 and the CD-ROM 31, or from the server computer 102 via the communication I/F 14, into an automatic performance data storage area of the RAM 7.

(2) If the player designates a change of the channel assigned to the keyboard 1 (guide channel), the designated channel is assigned to the keyboard 1 (S13→S15→S16→S24).

When a channel is assigned to the keyboard 1, a musical tone produced when the player depresses a key of the keyboard 1 assumes a tone color allotted to the channel. Further, visual guidance or voice guidance for guiding the fingering of the player is performed based on automatic performance data of the channel.

(3) If the player designates a change of the guidance/fingering function, a guidance/fingering function-setting subroutine, described in detail hereinbelow with reference to FIG. 6, is executed to switch the guidance/fingering function to a designated one (S13→S15→S17→S18→S24).

(4) If the player instructs a start of reproduction of a musical composition, data of the currently set musical composition is read out from the automatic performance data storage area of the RAM 7, to generate performance data for the musical composition (S13→S15 S17→S19→S20→S24).

(5) If the player instructs a stop of reproduction of a musical composition under automatic performance, reading of data of the musical composition is stopped, whereby reproduction of the musical composition is stopped (S13→S15→S17→S19→S21→S22→S24).

(6) If the player instructs designation of a function (e.g. fast forward or fast rearward of play of a musical composition) other than the above automatic performance-related functions (1) to (5), the designated function is performed (S13→S15→S17→S19→S21 S23→S24).

FIG. 6 shows in detail the guidance/fingering function-setting subroutine executed at the step S18.

The present subroutine sets any one of three functions included in each of the two kinds of performance guidance functions (i.e. the voice guidance function and the lamp guidance function). More specifically, as described above, as the voice guidance function, it is possible to selectively set any one of the three functions, i.e. (1) voice-aided tone-pitch guidance, (2) voice-aided pitch/fingering guidance, and (3) no setting (disabled), and as the lamp guidance function, it is possible to selectively set any one of the three modes, i.e. (4) lamp-aided keyboard guidance, (5) lamp-aided hand-motion/fingering guidance, and (6) no setting (disabled). Accordingly, the player selects a desired one of the functions (1) to (3), as the voice guidance function, and selects a desired one of the functions (4) to (6), as the lamp guidance function, thereby setting the selected function(s).

More specifically, as shown in FIG. 6, when the player has selected the voice guidance, one of the above functions (1) to (3) selected by the player is set (S31→S32→S33), while when the player has selected the lamp guidance, one of the above functions (4) to (6) selected by the player is set (S33→S34).

Figure 7A:
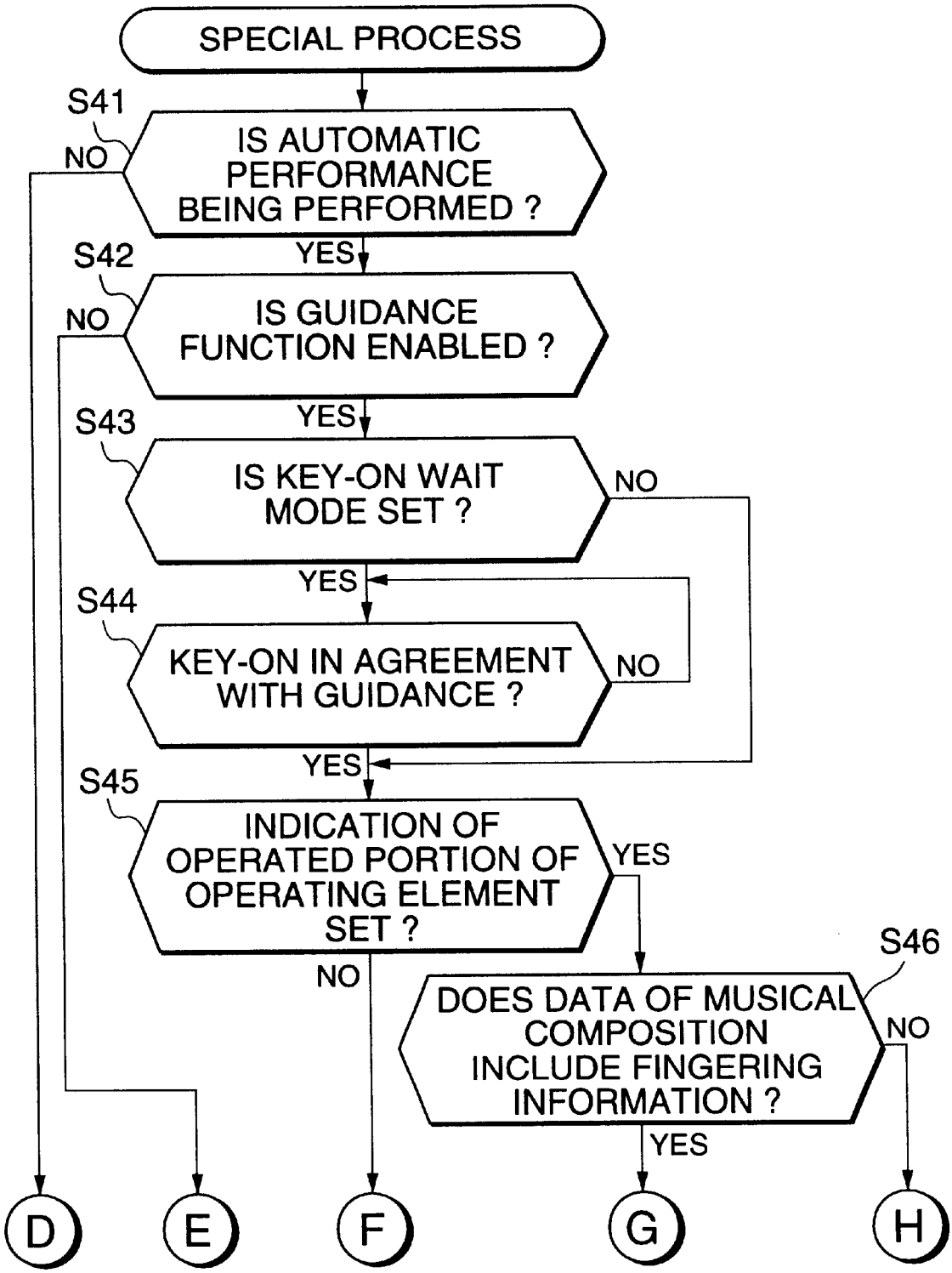
FIGS. 7A and 7B are a flowchart showing details of a special process in FIG. 4 executed by a subroutine therefor.
Figure 7B:
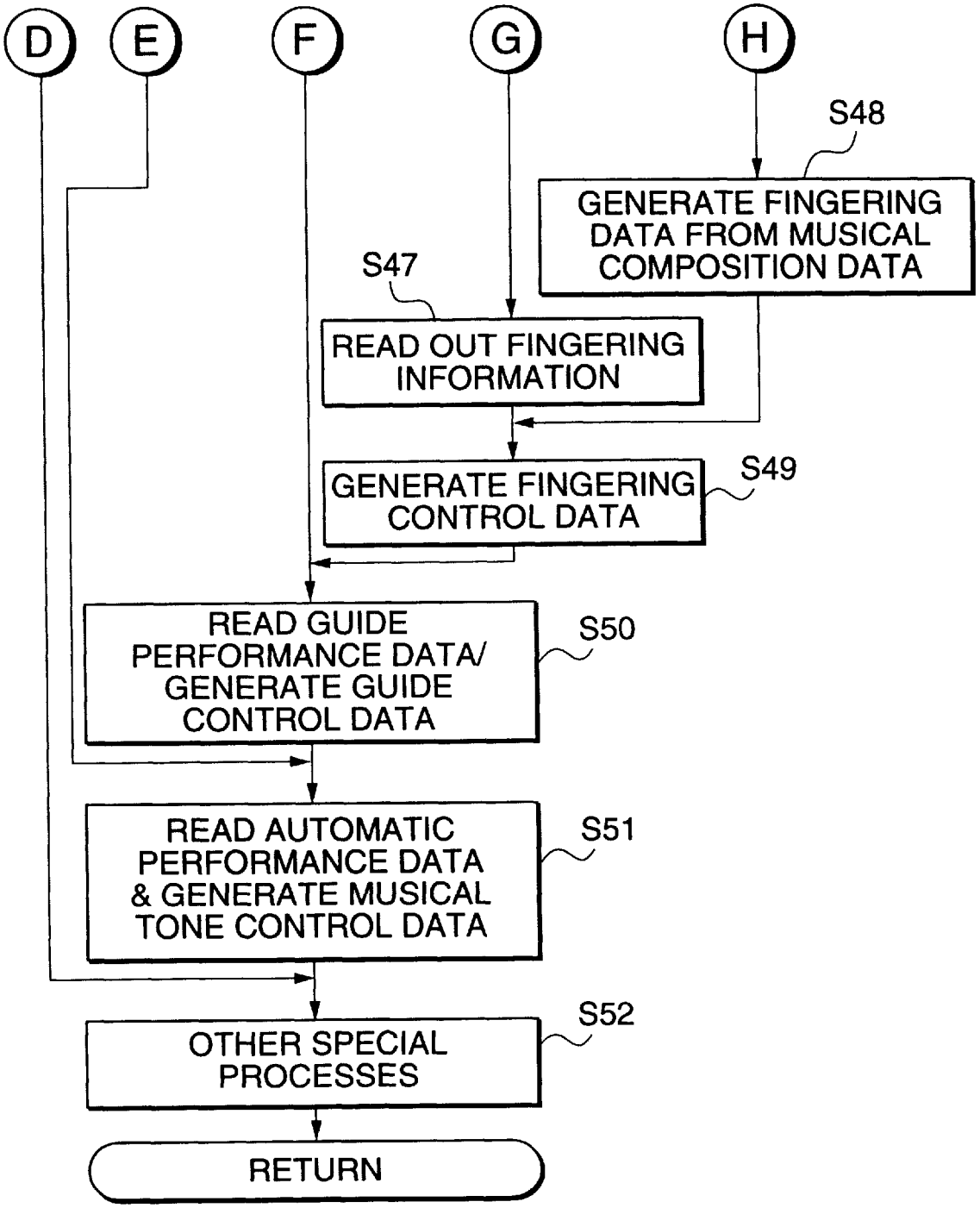

FIGS. 7A and 7B show in detail the special process subroutine to be executed at the step S6.

As shown in the figure, first, it is determined at a step S41 whether or not automatic performance is being executed. If automatic performance is being executed, steps S42 et seq. are carried out. On the other hand, if automatic performance is not being executed, other special processes are executed at a step S52, followed by terminating the program.

At the step S42, it is determined whether or not the guidance function is enabled. If the guidance function is not enabled, automatic performance data is read out to generate musical tone control data at a step S52, followed by the program proceeding to the step S52. On the other hand, if the guidance function is enabled, processing is executed as follows:

(1) When a key-on wait mode, i.e. a function of inhibiting automatic performance from proceeding until a key depression is carried out in accordance with the guidance, a key-on operation (key depression) in accordance with the guidance is awaited (S43→S44);

(2) When indication of operating elements to be operated is set, i.e. the fingering guidance is enabled, and at the same time data of a musical composition to be played (automatic performance data) contains fingering information, the fingering information is read out to generate fingering data, and then guide control data for use in reading guide performance data is generated (S45→S46→S47→S49→S50);

(3) When the indication of operating elements to be operated is set, but data of a musical composition to be played (automatic performance data) does not contain fingering information, fingering data is generated from data of the musical composition, e.g. by a method disclosed in Japanese Laid-Open Patent Publication (Kokai) No. 7-261750, and then guide control data for use in reading guide performance data is generated (S45→S46→S48→S49→S50).

(4) When the indication of operating elements to be operated is not set, guide control data for use in reading guide performance data is generated (S45→S50).

The term "guide performance data" in the above description means automatic performance data of the aforementioned guide channel.

As described above, according to the electronic musical instrument of the present embodiment, in the case where the "voice-aided pitch/fingering guidance" is selected and set as the voice guidance function, if fingering control data is embedded in the automatic performance data of the guide channel, the fingering control data is read out from the automatic performance data, whereas if fingering control data is not embedded, fingering control data is generated from the automatic performance data of the guide channel. Then, based on the fingering control data read out or generated, voice signals are generated by the voice guidance circuit 17, for sounding pitch names of the keys to be depressed by the player in voices of tone colors dependent on fingers to be operated by the player, and the voice signals thus generated are sounded for voice guidance by sending them via the DAC 18 and the sound system 19 to the voice guidance speaker 21. On the other hand, in the case where the "lamp-aided hand-motion/fingering guidance" is selected and set as the lamp guidance function, guide lamps 9*b* corresponding to respective keys to be depressed by the player are lighted, based on the fingering data, to indicate the keys for depression. At the same time, which hand to be used for depression of each key is indicated by lighting a corresponding one of the right and left LED's of the guide lamp 9*b* associated with the key, and which finger to be used is indicated by the brightness of the lighted LED. Further, when at least one of the voice guidance and the lamp guidance is enabled, a picture of the whole keyboard 1 is displayed on the LCD 9*a,* with a picture of both hands superimposed thereupon, and one or more fingers of the displayed hands in use for key depression are displayed in a manner distinguishable from the other fingers. The hand guidance is thus carried out, so that even a beginner can perform a smooth and ideal musical performance with ease.

Although in the present embodiment, performance guidance is carried out by using the guide lamps 9*b* arranged in a manner associated with respective keys of the keyboard 1, this is not limitative, but each key of the keyboard 1 may be constructed such that the key itself can emit light, similarly to the guide lamps 9*b,* whereby keys may be caused to emit light according to automatic performance data, for execution of performance guidance. In this case, a finger to be used for key depression may be indicated by a specific portion of the corresponding key from which light is emitted.

Further, although in the present embodiment, visual guidance is performed by using the guide lamps 9*b,* this is not limitative, but small liquid crystal displays may be arranged at a location generally identical to the location at which the guide lamps 9*b* are arranged, for each displaying a finger number in association with a key to be depressed. In this case, a number assigned to a finger to be used for key depression is displayed on a liquid crystal display corresponding to a key to be depressed. Further, the color of a back light of the display may be changed to indicate which hand to be used for the key depression.

Further, although in the embodiment, an electronic keyboard instrument is exemplified as the electronic musical instrument of the invention, this is not limitative, but the present invention is applicable to any other kind of electronic musical instrument (such as an electronic stringed instrument) which is provided with a plurality of operating elements and played by operating the operating elements by using a plurality parts of the player's body.

It goes without saying that the object of the present invention may be accomplished by supplying a storage medium in which is recorded a software program realizing the functions of the electronic musical instrument of the above-described embodiment to a system or apparatus, and causing a computer (CPU 5 or MPU) of the system or apparatus to read out and execute the program stored in the storage medium.

In this case, the code of the program itself read out from the storage medium achieves the novel functions of the present invention, and the storage medium storing the program constitutes the present invention.

The storage medium for supplying the program to the system or apparatus may be in the form of the floppy disk 30, the hard disk, an optical memory disk, an magneto-optical disk, the CD-ROM 31, a CD-R (CD-Recordable), a magnetic tape, a nonvolatile memory card, or the ROM 6, for instance. Also, the program may be supplied from the other MIDI equipment 100 or the server computer 102 through the communication network 101.

It goes without saying that the present invention encompasses a case in which the functions of the illustrated embodiment are accomplished not only by executing the program read out by the computer, but also by causing an OS operating on the computer to perform a part or all of actual operations according to the instructions of the program.

Further, the present invention also encompasses a case in which the program read out from the storage medium is written in a memory provided in an expanded function board inserted in the computer, or in an expanded function unit connected to the computer, and then the CPU 5 or the like integrated in the expanded function board or expanded function unit actually performs a part of or all of the operations, based on the instructions of the program, so as to accomplish the functions of the illustrated embodiment.

What is claimed is:

1. An electronic musical instrument having a plurality of performance operating elements that are operated for performance by a player such that different parts of a body of said player are selectively used to operate predetermined ones of said performance operating elements, the electronic musical instrument comprising:

an input device that inputs performance data of a musical composition for which said player is guided for performance; and a plurality of display devices that are arranged in association with said performance operating elements, respectively, said display devices each comprising a pair of display elements corresponding to left and right hands of said player, respectively, said display devices being each responsive to the input performance data for indicating to said player a position of a corresponding one of said performance operating elements to be operated by said player and one of the left and right hands to be used in operating said corresponding one of said performance operating elements, by driving a corresponding one of said pair of display elements in a manner corresponding to said one of the left and right hands;

wherein one of said pair of display elements corresponding to one of the left and right hands of said player indicates a finger of said one of the left and right hands of said player to be used in operating said corresponding one of said performance operating elements, in a display manner corresponding to said finger.

2. An electronic musical instrument according to claim 1, wherein said pair of display elements indicate respective corresponding ones of the left and right hands of said player in different colors from each other.

3. An electronic musical instrument having a plurality of performance operating elements that are operated for performance by a player such that different parts of a body of said player are selectively used to operate predetermined ones of said performance operating elements, the electronic musical instrument comprising:

an input device that inputs performance data of a musical composition for which said player is guided for performance; and a plurality of display devices that are arranged in association with said performance operating elements, respectively, said display devices each comprising a pair of display elements corresponding to left and right hands of said player, respectively, said display devices being each responsive to the input performance data for indicating to said player a position of a corresponding one of said performance operating elements to be operated by said player and one of the left and right hands to be used in operating said corresponding one of said performance operating elements, by driving a corresponding one of said pair of display elements in a manner corresponding to said one of the left and right hands;

wherein one of said pair of display elements corresponding to one of the left and right hands of said player indicates a finger of said one of the left and right hands of said player to be used in operating said corresponding one of said performance operating elements, in a display manner corresponding to said finger; and wherein one of said pair of display elements corresponding to one of the left and right hands of said player is driven to emit light with a level of brightness corresponding to a finger of said one of the left and right hands of said player to be used in operating said corresponding one of said performance operating elements, to thereby indicate the finger.

4. An electronic musical instrument having a plurality of performance operating elements that are operated for performance by a player such that different parts of a body of said player are selectively used to operate predetermined ones of said performance operating elements, the electronic musical instrument comprising:

an input device that inputs performance data of a musical composition for which said player is guided for performance;

a plurality of first display devices that are arranged in association with said performance operating elements, respectively, said first display devices being each responsive to the input performance data for indicating to said player a position of a corresponding one of said performance operating elements to be operated by said player and one of said different parts of said body to be used in operating said corresponding one of said performance operating elements, in a manner corresponding to said one of said different parts of said body; and a second display device provided independently of said plurality of performance operating elements for displaying a picture representative of said plurality of performance operating elements, said second display device being responsive to the input performance data for displaying a position of each of said performance elements to be operated by said player on said picture displayed on said second display device, and simultaneously displaying a pattern corresponding to one of said different parts of said body to be used in operating said each of said performance operating elements in a manner associated with an image of said each of said performance operating elements to be operated by said player in said picture.

5. An electronic musical instrument according to claim 4, wherein said first display devices are each responsive to the input performance data for indicating to said player said position of said corresponding one of said performance operating elements to be operated by said player and said one of said different parts of said body to be used in operating said corresponding one of said performance operating elements, in a color corresponding to said one of said different parts of said body.

6. An electronic musical instrument having a plurality of performance operating elements that are operated for performance by a player such that different parts of a body of said player are selectively used to operate predetermined ones of said performance operating elements, the electronic musical instrument comprising:

an input device that inputs performance data of a musical composition for which said player is guided for performance; and an indicating device that is responsive to the input performance data for sounding a pitch name corresponding to a position of each of said performance operating elements to be operated by said player in a voice having a tone color corresponding to one of said different parts of said body to be used in operating said each of said performance elements.

7. An electronic musical instrument according to claim 6, wherein said indicating device sounds said pitch name in a voice having a tone color different depending on whether said one of said different parts of said body to be used in operating said each of said performance elements is a left hand of said player or a right hand of same.

8. An electronic musical instrument according to claim 6, wherein said indicating device sounds said pitch name in a voice having a tone color different depending on a finger of said player to be used in operating said each of said performance elements.

9. An electronic musical instrument according to claim 6, further comprising a plurality of display devices that are arranged in association with said performance operating elements, respectively, said display devices being each responsive to the input performance data for indicating to said player a position of a corresponding one of said performance operating elements to be operated by said player and one of said different parts of said body to be used in operating said corresponding one of said performance operating elements.

10. An electronic musical instrument according to claim 9, wherein said display devices each display said position of said corresponding one of said performance operating elements to be operated by said player and said one of said different parts of said body to be used in operating said corresponding one of said performance operating elements in a manner corresponding to said one of said different parts of said body.

11. An electronic musical instrument according to claim 6, further comprising a display device provided independently of said plurality of performance operating elements for displaying a picture representative of said plurality of performance operating elements, said display device being responsive to the input performance data for displaying said position of said each of said performance elements to be operated by said player on said picture displayed on said display device.

12. An electronic musical instrument according to claim 11, wherein said display device displays a pattern corresponding to said one of said different parts of said body to be used in operating said each of said performance operating elements in a manner associated with an image of said each of said performance operating elements to be operated by said player in said picture.

13. A method of guiding a player for performance, said player playing on an electronic musical instrument having a plurality of performance operating elements that are operated for performance by said player such that different parts of a body of said player are used to suitably operate predetermined ones of said performance operating elements, the method comprising the steps of:

arranging a plurality of display devices in association with said performance operating elements, respectively, said display devices each comprising a pair of display elements corresponding to left and right hands of said player, respectively;

inputting automatic performance data of a musical composition for which said player is guided for performance; and indicating to said player a position of each of said performance operating elements to be operated by said player and one of the left and right hands to be used in operating said each of said performance operating elements, by driving a corresponding one of said pair of display elements of a corresponding one of said display devices in a manner corresponding to said one of the left and right hands, in response to the input performance data;

wherein one of said pair of display elements corresponding to one of the left and right hands of said player indicates a finger of said one of the left and right hands of said player to be used in operating said corresponding one of said performance operating elements, in a display manner corresponding to said finger.

14. A method of guiding a player for performance, said player playing on an electronic musical instrument having a plurality of performance operating elements that are operated for performance by said player such that different parts of a body of said player are used to suitably operate predetermined ones of said performance operating elements, the method comprising the steps of:

arranging a plurality of first display devices in association with said performance operating elements, respectively;

arranging a second display device independently of said plurality of performance operating elements;

inputting performance data of a musical composition for which said player is guided for performance; and indicating to said player a position of a corresponding one of said performance operating elements to be operated by said player and one of said different parts of said body to be used in operating said corresponding one of said performance operating elements, by driving a corresponding one of said plurality of first display devices in a manner corresponding to said one of said different parts of said body, in response to the input performance data; and displaying a position of each of said performance elements to be operated by said player on said picture displayed on said second display device, and simultaneously displaying a pattern corresponding to one of said different parts of said body to be used in operating said each of said performance operating elements in a manner associated with an image of said each of said performance operating elements to be operated by said player in said picture, by driving said second display device in response to the input performance data.

15. A method of guiding a player for performance, said player playing on an electronic musical instrument having a plurality of performance operating elements that are operated for performance by said player such that different parts of a body of said player are used to suitably operate predetermined ones of said performance operating elements, the method comprising the steps of:

inputting performance data of a musical composition for which said player is guided for performance; and sounding a pitch name corresponding to a position of each of said performance operating elements to be operated by said player in a voice having a tone color corresponding to one of said different parts of said body to be used in operating said each of said performance elements, in response to the input performance data.

16. A storage medium storing a program that can be executed by a computer, said program be capable of realizing a method of guiding a player for performance, said player playing on an electronic musical instrument having a plurality of performance operating elements that are operated for performance by said player such that different parts of a body of said player are used to suitably operate predetermined ones of said performance operating elements, and a plurality of display devices arranged in association with said performance operating elements, respectively, said display devices each comprising a pair of display elements corresponding to left and right hands of said player, respectively, said program comprising:

an input module for inputting automatic performance data of a musical composition for which said player is guided for performance; and an indication module for indicating to said player a position of each of said performance operating elements to be operated by said player and one of the left and right hands to be used in operating said each of said performance operating elements, by driving a corresponding one of said pair of display elements of a corresponding one of said display devices in a manner corresponding to said one of the left and right hands, in response to the input performance data;

wherein one of said pair of display elements corresponding to one of the left and right hands of said player indicates a finger of said one of the left and right hands of said player to be used in operating said corresponding one of said performance operating elements, in a display manner corresponding to said finger.

17. A storage medium storing a program that can be executed by a computer, said program be capable of realizing a method of guiding a player for performance, said player playing on an electronic musical instrument having a plurality of performance operating elements that are operated for performance by said player such that different parts of a body of said player are used to suitably operate predetermined ones of said performance operating elements, a plurality of first display devices that are arranged in association with said performance operating elements, respectively, and a second display device provided independently of said plurality of performance operating elements for displaying a picture representative of said plurality of performance operating elements, said program comprising:

an input module for inputting performance data of a musical composition for which said player is guided for performance;

an indicating module for indicating to said player a position of a corresponding one of said performance operating elements to be operated by said player and one of said different parts of said body to be used in operating said corresponding one of said performance operating elements, by driving a corresponding one of said plurality of first display devices in a manner corresponding to said one of said different parts of said body, in response to the input performance data; and a displaying module for displaying a position of each of said performance elements to be operated by said player on said picture displayed on said second display device, and simultaneously displaying a pattern corresponding to one of said different parts of said body to be used in operating said each of said performance operating elements in a manner associated with an image of said each of said performance operating elements to be operated by said player in said picture, by driving said second display device in response to the input performance data.

18. A storage medium storing a program that can be executed by a computer, said program be capable of realizing a method of guiding a player for performance, said player playing on an electronic musical instrument having a plurality of performance operating elements that are operated for performance by said player such that different parts of a body of said player are used to suitably operate predetermined ones of said performance operating elements, said program comprising:

an input module for inputting performance data of a musical composition for which said player is guided for performance; and an indicating module for sounding a pitch name corresponding to a position of each of said performance operating elements to be operated by said player in a voice having a tone color corresponding to one of said different parts of said body to be used in operating said each of said performance elements, in response to the input performance data.

19. A method of guiding a player for performance, said player playing on an electronic musical instrument having a plurality of performance operating elements that are operated for performance by said player such that different parts of a body of said player are used to suitably operate predetermined ones of said performance operating elements, the method comprising the steps of:

arranging a plurality of display devices in association with said performance operating elements, respectively, said display devices each comprising a pair of display elements corresponding to left and right hands of said player, respectively;

inputting automatic performance data of a musical composition for which said player is guided for performance; and indicating to said player a position of each of said performance operating elements to be operated by said player and one of the left and right hands to be used in operating said each of said performance operating elements, by driving a corresponding one of said pair of display elements of a corresponding one of said display devices in a manner corresponding to said one of the left and right hands, in response to the input performance data;

wherein one of said pair of display elements corresponding to one of the left and right hands of said player indicates a finger of said one of the left and right hands of said player to be used in operating said corresponding one of said performance operating elements, in a display manner corresponding to said finger;

wherein one of said pair of display elements corresponding to one of the left and right hands of said player is driven to emit light with a level of brightness corresponding to a finger of said one of the left and right hands of said player to be used in operating said corresponding one of said performance operating elements, to thereby indicate the finger.

20. A storage medium storing a program that can be executed by a computer, said program be capable of realizing a method of guiding a player for performance, said player playing on an electronic musical instrument having a plurality of performance operating elements that are operated for performance by said player such that different parts of a body of said player are used to suitably operate predetermined ones of said performance operating elements, and a plurality of display devices arranged in association with said performance operating elements, respectively, said display devices each comprising a pair of display elements corresponding to left and right hands of said player, respectively, said program comprising:

an input module for inputting automatic performance data of a musical composition for which said player is guided for performance; and an indication module for indicating to said player a position of each of said performance operating elements to be operated by said player and one of the left and right hands to be used in operating said each of said performance operating elements, by driving a corresponding one of said pair of display elements of a corresponding one of said display devices in a manner corresponding to said one of the left and right hands, in response to the input performance data;

wherein one of said pair of display elements corresponding to one of the left and right hands of said player indicates a finger of said one of the left and right hands of said player to be used in operating said corresponding one of said performance operating elements, in a display manner corresponding to said finger;

wherein one of said pair of display elements corresponding to one of the left and right hands of said player is driven to emit light with a level of brightness corresponding to a finger of said one of the left and right hands of said player to be used in operating said corresponding one of said performance operating elements, to thereby indicate the finger.

* * * * *